US007586417B2

(12) United States Patent
Chisholm

(10) Patent No.: US 7,586,417 B2
(45) Date of Patent: Sep. 8, 2009

(54) RFID INSERT WITH DISABLE FEATURE AND CONTAINER THAT INCLUDES SUCH AN INSERT

(75) Inventor: Brian J. Chisholm, Sylvania, OH (US)

(73) Assignee: Rexam Healthcare Packaging Inc., Perrysburg, OH (US)

( * ) Notice: Subject to any disclaimer, the term of this patent is extended or adjusted under 35 U.S.C. 154(b) by 340 days.

(21) Appl. No.: 11/595,372

(22) Filed: Nov. 10, 2006

(65) Prior Publication Data

US 2008/0111696 A1 May 15, 2008

(51) Int. Cl.
*G08B 13/14* (2006.01)

(52) U.S. Cl. ..... 340/572.8; 340/572.4; 340/572.7; 235/385; 235/492; 206/459.5; 206/216; 264/293; 264/320; 264/322

(58) Field of Classification Search ..... 340/572.8, 340/572.4, 572.7; 235/385, 492; 206/459.5, 206/216; 264/293, 320, 322
See application file for complete search history.

(56) References Cited

U.S. PATENT DOCUMENTS

| | | | | |
|---|---|---|---|---|
| 4,669,620 | A | 6/1987 | Coifman | |
| 5,341,947 | A | 8/1994 | Rosse et al. | |
| 6,226,619 | B1 | 5/2001 | Halperin et al. | |
| 7,017,807 | B2 * | 3/2006 | Kipp et al. | 235/385 |
| 7,070,053 | B1 | 7/2006 | Abrams et al. | |
| 7,098,794 | B2 * | 8/2006 | Lindsay et al. | 340/572.3 |
| 7,338,914 | B2 * | 3/2008 | Conwell et al. | 442/149 |
| 2006/0086808 | A1 | 4/2006 | Appalucci et al. | |

FOREIGN PATENT DOCUMENTS

| | | | |
|---|---|---|---|
| DE | 102004061633 | A1 | 6/2006 |
| EP | 1382533 | A2 | 1/2004 |
| EP | 1767461 | A2 | 3/2007 |
| WO | 2007006109 | A1 | 1/2007 |

OTHER PUBLICATIONS

Notification of Transmittal of the International Search Report and the Written Opinion of the International Searching Authority, PCT/ISA/220, for PCT/US2007/016286 mailed Dec. 28, 2007.
International Search Report, PCT/ISA/210, for PCT/US2007/016286 mailed Dec. 28, 2007.
Written Opinion of the International Searching Authority, PCT/ISA/237, for PCT/US2007/016286 mailed Dec. 28, 2007.

* cited by examiner

*Primary Examiner*—Tai T Nguyen
(74) *Attorney, Agent, or Firm*—Reising Ethington PC

(57) ABSTRACT

An RFID insert includes a housing of molded plastic construction and an RFID tag captured within the housing. A portion of the housing is permanently frangibly removable from the remainder of the housing to remove the RFID tag from within the housing and thereby disable RFID operation of the insert. The housing preferably includes a center portion connected to a ring-shaped periphery by a plurality of angularly spaced frangible bridges. The center portion of the housing may include a slot or pocket for engagement by a tool to twist the center portion with respect to the periphery and thereby facilitate rupture of the bridges, and/or may include indicia to identify presence of the RFID tag in the insert.

15 Claims, 2 Drawing Sheets

RFID INSERT WITH DISABLE FEATURE AND CONTAINER THAT INCLUDES SUCH AN INSERT

The present disclosure relates to a molded plastic container having a radio frequency identification (RFID) tag molded into a wall of the container, and to an RFID insert for molding into a wall of a container.

BACKGROUND AND SUMMARY OF THE DISCLOSURE

It has been proposed to place an RFID tag on or in a wall of a container to confirm the genuineness of the package that includes the container and/or to provide other information concerning the package or a product within the package. Such RFID tag can be secured to a wall of the container after fabrication of the container, embedded in a wall of the container during blow molding of the container, or assembled to a container preform in such a way that the tag will be embedded in a wall of the container following blow molding of the preform. There is a desire to provide a means for disabling the RFID tag, which typically includes an RFID circuit and an antenna, to maintain the privacy of a customer, for example. When the customer purchases a package of medication, for example, the tag should be in place to confirm genuineness of the package and/or for other information purposes. However, after purchase, the customer may want to have the RFID tag removed, without opening the package, for privacy or other reasons. A general object of the present disclosure is to provide an RFID insert in which the RFID tag can be readily removed and/or to provide a container that includes such an RFID insert.

The present disclosure embodies a number of aspects that can be implemented separately from or in combination with each other.

An RFID insert, in accordance with one aspect of the present disclosure, includes a housing of molded plastic construction and an RFID tag captured within the housing. A portion of the housing is permanently frangibly removable from the remainder of the housing to remove the RFID tag from within the housing and thereby disable RFID operation of the insert. The housing preferably includes a center portion connected to a ring-shaped periphery by a plurality of angularly spaced frangible bridges. The center portion of the housing may include a slot or pocket for engagement by a tool to twist the center portion with respect to the periphery and thereby facilitate rupture of the bridges, and/or may include indicia to identify presence of the RFID tag in the insert.

An RFID insert, in an exemplary embodiment of the disclosure, and in accordance with another aspect of the disclosure, includes a base having a peripheral wall, a disk having a periphery internally engaged with the peripheral wall, and an RFID inlay, including an RFID tag, captured between the disk and the base. One of the disk and the base, preferably the disk, has a portion that is removable for removing the RFID inlay and thereby disabling the RFID insert.

A molded plastic container in accordance with a further aspect of the present disclosure includes a container body having a base and an RFID insert molded into the container base. The ring-shaped periphery of the RFID insert housing preferably includes a wall that prevents flow of container material onto the center portion of the insert during the blow molding operation.

BRIEF DESCRIPTION OF THE DRAWINGS

The disclosure, together with additional objects, features, advantages and aspects thereof, will best be understood from the following description, the appended claims and the accompanying drawings, in which:

DETAILED DESCRIPTION OF PREFERRED EMBODIMENTS

Figure 1:
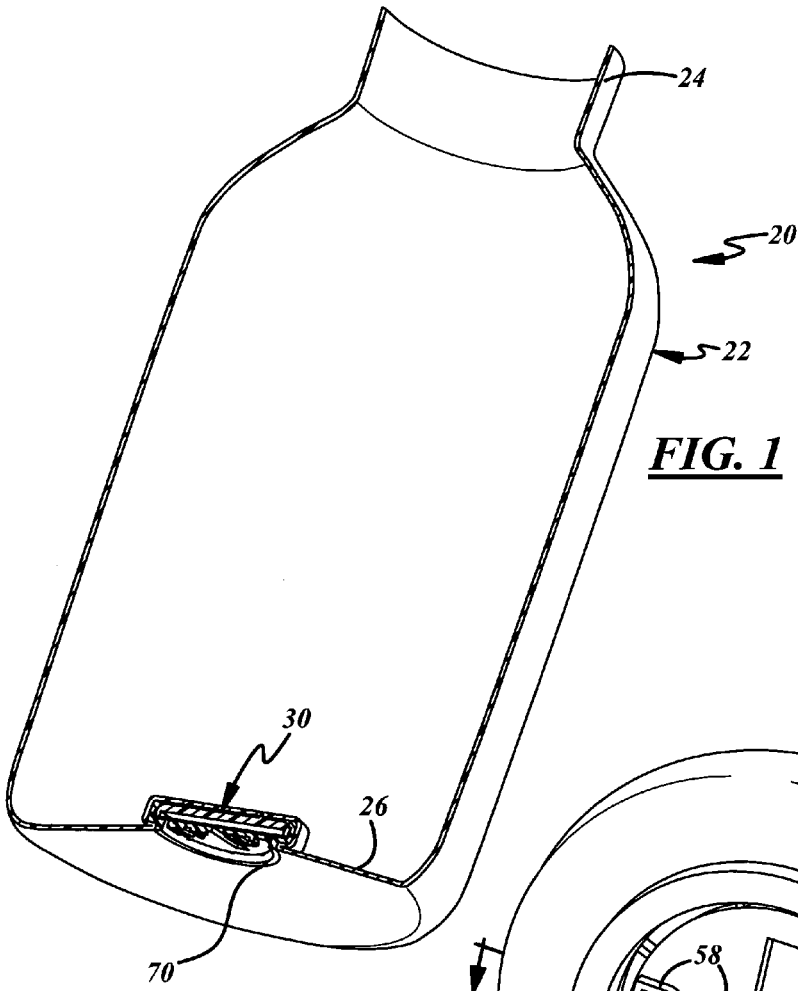
FIG. 1 is a perspective sectional view of a plastic container in accordance with an exemplary implementation of the present disclosure.

FIG. 1 illustrates a container 20 in accordance with an exemplary embodiment of the present disclosure. Container 20 includes a body 22 having an open end 24 and a container base 26. Base 26 typically, although not necessarily, is at the opposite end of container body 22 from open end 24, and typically although not necessarily is at the end of the container body on which the container body normally rests. Base 26 may be flat, concave or of any other suitable geometry. The geometry of container body 22 illustrated in FIG. 1 is by way of example only.

An RFID insert 30 is molded into a wall of container 20, preferably into base 26. One embodiment of RFID insert 30 is illustrated in greater detail in FIGS. 2-4 as including an RFID inlay 32 disposed within a plastic housing 34. Plastic housing 34, in the exemplary embodiment of FIGS. 2-4, includes a base 36 having a peripheral wall 38, and a disk 40 having a periphery internally engaging peripheral wall 38. RFID inlay 32 is captured between base 36 and disk 40, and may include an RFID circuit or tag 42 coupled to an rf antenna 44 and deposited on a substrate 46. It also is envisioned that the inlay could be composed only of circuit or tag 42 with a built-in antenna and without a substrate. As an alternative to the multi-piece housing 34, housing 34 may be of one-piece plastic construction into which inlay 32 is insert molded. RFID insert 30 preferably has a plurality of fingers, prongs, lugs or other suitable features 48 (FIG. 3) for attaching assembly 30 to a container preform as disclosed in U.S. application Ser. No. 11/595,059 prior to blow molding the preform into a container. The disclosure of such application is incorporated herein by reference. RFID insert 30 can be molded into container body 22 (FIG. 1) in any other suitable manner.

Figure 2:
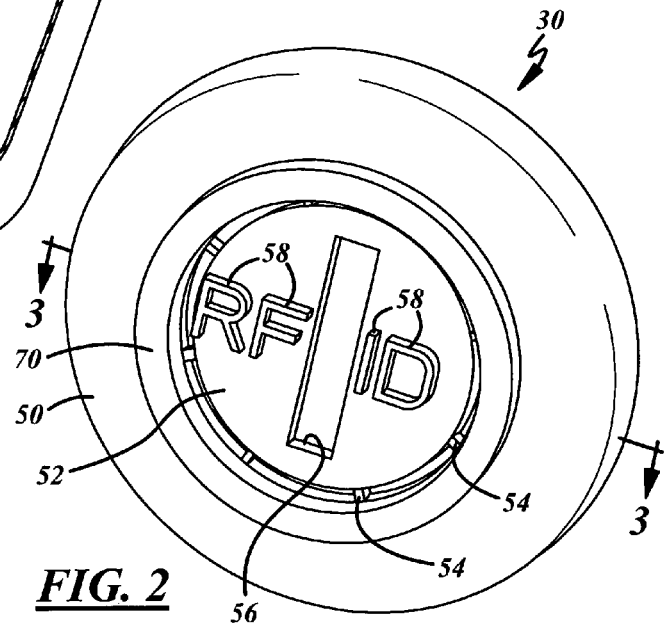
FIG. 2 is a perspective view of the RFID insert in the container of FIG. 1.
Figure 3:
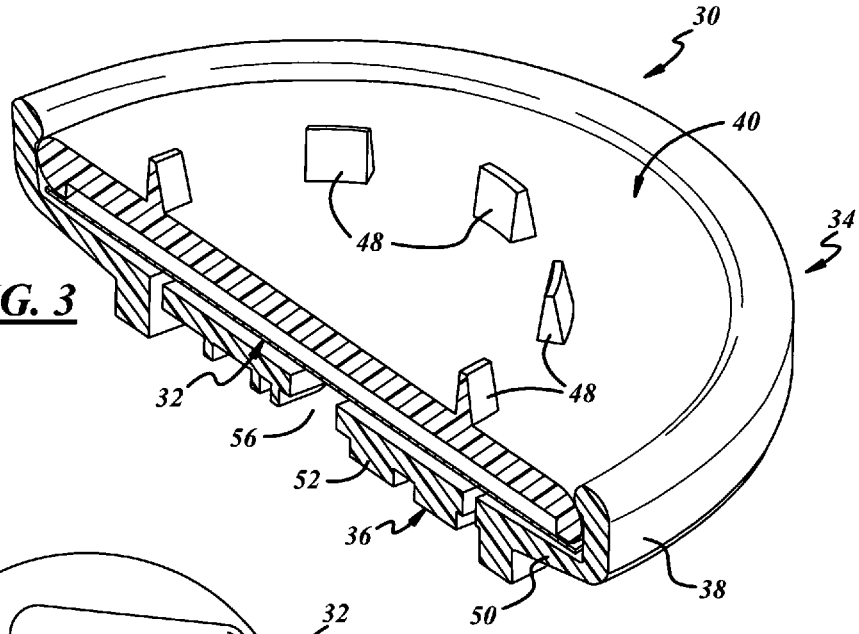
FIG. 3 is a perspective sectional view of the RFID insert in FIG. 2, being taken substantially along the line 3-3 in FIG. 2.
Figure 4:
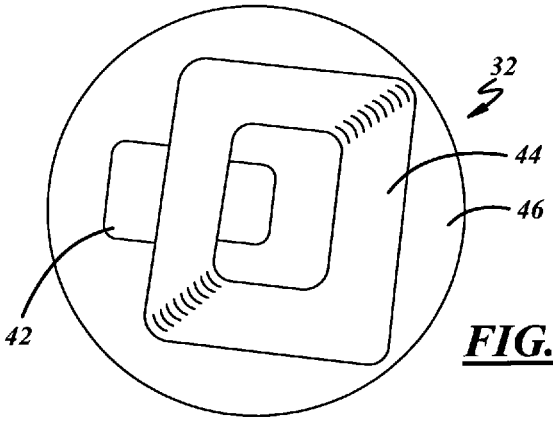
FIG. 4 is a plan view of the RFID inlay in the RFID insert of FIGS. 2 and 3.

In housing 34 illustrated in FIGS. 2-4, base 36 includes a ring-shaped periphery 50 and a center portion 52 disposed within periphery 50. Center portion 52 is connected to periphery 50 by frangible means, preferably in the form of a plurality of angularly spaced frangible bridges 54 (FIG. 2). Thus, with periphery 50 of base 36 and disk 40 of housing 34 permanently secured to container base wall 26, center portion 52 can be permanently severed from periphery 50 by twisting center portion 52 and rupturing bridges 54. ("Permanent" securement of periphery 50 and disk 40 to container body 22 means that these elements cannot be separated without substantial destruction to one or all elements.) To facilitate twisting of center portion 52 with respect to periphery 50, a slot or pocket 56 (FIGS. 2 and 3) maybe provided for insertion of a tool, such as a screwdriver or a coin, to twist center portion 52 while holding container body 22 to which periphery 50 is permanently secured. As also shown in FIG. 2, indicia 58, such as "RFID," preferably are provided on center portion 52 to identify to a user that the RFID capability is in place. Indicia 58 can be printed on or molded onto center portion 52, for example. Housing 34 preferably has a circular peripheral geometry. However, the ring-shaped periphery could have a square or other non-circular geometry, for example, as long as the center portion can be flexed or moved with respect to the periphery to rupture the frangible bridges. The frangible bridges could be replaced by a circumferentially continuous frangible web.

Figure 5:
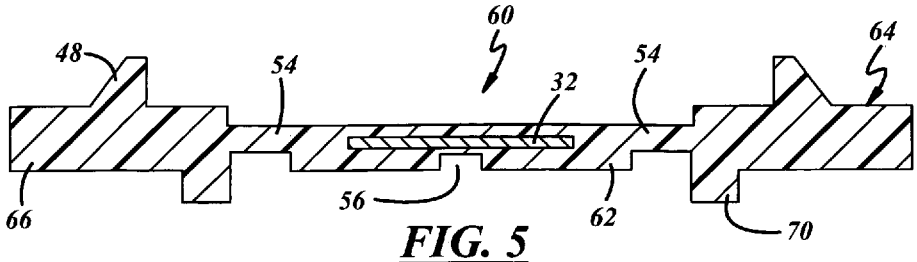
FIG. 5 is a sectional view of an RFID insert in accordance with another exemplary embodiment of the present disclosure.

FIG. 5 illustrates an RFID insert 60 in which RFID inlay 32 is insert molded into the center portion 62 of a molded plastic housing 64. Housing 64, including center portion 62 and a ring-shaped periphery 66, is thus of one-piece integrally molded plastic construction in this embodiment. Center portion 62 is connected to the periphery 66 of housing 64 by means of a plurality of angularly spaced frangible bridges 54. Periphery 66 also includes lugs, fingers or other suitable features 48 for molding assembly 60 into a wall of the container, preferably the base of the container as previously described.

Periphery 50 of base 36 (FIGS. 2 and 3) and periphery 66 of housing 64 (FIG. 5) preferably include an annular wall 70 that is positioned to engage the opposing face of a blow mold during blow molding of the preform, and thereby to prevent flow of container material into or onto the removable center portion of the housing, as best seen in FIG. 1. In the exemplary embodiments of the disclosure, the RFID insert is disposed in a pocket that is formed around the insert during blow molding of the container body, as disclosed in the above-referenced application. However, the insert may be secured to the container in any manner as long as the periphery of the insert is permanently affixed to the container and the center portion of the insert is accessible by a user for removal and disablement of RFID operation. It is preferred that substantially only the removable center portion of the RFID assembly is visible on the wall of the container, preferably the container base.

There thus have been disclosed an RFID insert and a molded plastic container that includes such an insert that fully satisfy all of the objects and aims previously set forth. The disclosure has been presented in conjunction with exemplary embodiments, and additional modifications and variations have been discussed. Other modifications and variations readily will suggest themselves to persons of ordinary skill in the art in view of the foregoing description. For example, additional security features can be incorporated into the RFID insert and/or the container, such as microtaggents, chemical tracers, fluorescent agents or other features, overt and/or covert. The disclosure is intended to embrace all such modifications and variations as fall within the spirit and broad scope of the appended claims.

The invention claimed is:

1. An RFID insert that includes a housing of molded plastic construction and an RFID tag captured within said housing, a portion of said housing being permanently frangibly removable from said housing to remove said RFID tag from within said housing and thereby disable RFID operation of said insert, said housing including a ring-shaped periphery and said portion comprising a center portion within said periphery, said center portion being connected to said periphery by a plurality of angularly spaced frangible bridges.

2. The insert set forth in claim 1 wherein said center portion includes a slot for engagement by a tool to twist said center portion with respect to said periphery and rupture said bridges.

3. The insert set forth in claim 1 including indicia on said center portion to identify presence of said RFID tag in said insert.

4. The insert set forth in claim 1 wherein said housing is of multi-piece construction.

5. The insert set forth in claim 1 wherein said housing is of one-piece integrally molded construction.

6. An RFID insert that includes:

a base having a peripheral wall, a disk having a periphery internally engaging said peripheral wall, and an RFID inlay, including an RFID tag, captured between said disk and said base, one of said base and said disk having a portion that is removable for removing said RFID inlay and thereby deactivating said RFID insert, said one of said base and said disk having a ring-shaped periphery and said portion comprising a center portion within said periphery that is connected to said periphery by angularly spaced frangible bridges that extend between said periphery and said center portion, and said center portion within said periphery including a slot for engagement by a tool to twist said center portion and rupture said frangible bridges from said periphery.

7. A molded plastic container that includes a container body having a base and an RFID insert molded into said base, said RFID insert including a housing of molded plastic construction and an RFID tag captured within said housing, a portion of said housing being permanently frangibly removable from said housing to remove said RFID tag from within said housing and thereby disable RFID operation of said insert, said housing including a ring-shaped periphery and said portion comprising a center portion within said periphery, said center portion being connected to said periphery by a plurality of angularly spaced frangible bridges and including a slot for engagement by a tool to twist said center portion with respect to said periphery and rupture said frangible bridges.

8. The container set forth in claim 7 including indicia on said center portion to identify presence of said RFID tag in said container.

9. The container set forth in claim 7 wherein said housing is of multi-piece construction.

10. The container set forth in claim 7 wherein said housing is of one-piece integrally molded container.

11. The container set forth in claim 7 wherein said base includes an external pocket within which said insert is disposed.

12. The container set forth in claim 11 wherein said container is blow molded around said RFID insert, and said periphery includes a wall that prevents flow of container material onto said center portion during blow molding.

13. A molded plastic container that includes a container body having a base and an RFID insert molded into said base, said RFID insert including a housing of molded plastic construction and an RFID tag captured within said housing, a portion of said housing being permanently frangibly removable from said housing to remove said RFID tag from within said housing and thereby disable RFID operation of said insert, said housing including a ring-shaped periphery and said portion comprising a center portion within said periphery, said base including an external pocket within which said insert is disposed, said container being blow molded around said RFID insert, and said periphery including a wall that prevents flow of container material onto said center portion during blow molding.

14. The container set forth in claim 13 wherein said center portion is connected to said periphery by a plurality of angularly spaced frangible bridges.

15. The container set forth in claim 14 wherein said center portion includes a slot for engagement by a tool to twist said center portion with respect to said periphery and rupture said bridges.

* * * * *